US006264589B1

(12) United States Patent
Chen

(10) Patent No.: US 6,264,589 B1
(45) Date of Patent: Jul. 24, 2001

(54) GRIPPING STRUCTURE OF EXERCISE MACHINE

(76) Inventor: James Chen, No. 35, Tun Hi Rd., Chin Chan Li, Sa Lu, Taichung (TW)

( * ) Notice: Subject to any disclaimer, the term of this patent is extended or adjusted under 35 U.S.C. 154(b) by 0 days.

(21) Appl. No.: 09/294,356

(22) Filed: Apr. 20, 1999

(51) Int. Cl.[7] ..... A63B 21/00
(52) U.S. Cl. ..... 482/139
(58) Field of Search ..... 482/100, 92, 99, 482/101, 93, 102, 148, 908, 135–137, 139; D21/673, 679

(56) References Cited

U.S. PATENT DOCUMENTS 4,461,473 * 7/1984 Cole ..... 482/106
4,585,229 * 4/1986 Brasher ..... 482/139
4,618,143 * 10/1986 Twardosz ..... 482/106
4,629,184 * 12/1986 Selkee ..... 482/106
5,080,349 * 1/1992 Vittone ..... 482/106
5,344,374 * 9/1994 Telle ..... 482/97
5,407,405 * 4/1995 Oren ..... 482/50
5,718,654 * 2/1998 Kennedy ..... 482/139

* cited by examiner

*Primary Examiner*—Mickey Yu
*Assistant Examiner*—Victor Hwang
(74) *Attorney, Agent, or Firm*—Browdy and Neimark

(57) ABSTRACT

A gripping structure of an exercise machine comprises one or more frames and one or more gripping members equal in number to the frames, which are fastened with the force application portion of an operation rod of the exercise machine and are formed of a plurality of rails. The gripping members are provided with a gripping portion to accommodate the hand of an exerciser and are slidably disposed in the frames such that the gripping members are displaced in a direction away from or toward the operation rod of the exercise machine. The interface between the gripping member and the frame is padded to provide a frictional resistance.

12 Claims, 7 Drawing Sheets

GRIPPING STRUCTURE OF EXERCISE MACHINE

FIELD OF THE INVENTION

The present invention relates generally to an exercise machine, and more particularly to a gripping structure of the exercise machine.

BACKGROUND OF THE INVENTION

As shown in FIG. 1, a chest building machine 1 of the prior art comprises two operation rods 2 and two curved handles 3 which are fastened with the operation rods 2 for holding fast with hands of an exerciser seated on a seat of the machine. As the handles 3 are pushed forward, the weights 4 are lifted by a steel cable for building the triceps of the upper arms and the pectoral muscle of the chest of the exerciser. Another prior art exercise machine 5 is shown in FIG. 2 and is mainly composed of a pull cord 6 which is connected at one end thereof with a cross rod which is provided with a handle 7 fastened therewith such that the weights 8 can be lifted by a cord fastened with the cross rod at the time when the handle 7 is gripped with hands of an exerciser to actuate the cross rod. The machine 5 is intended for building the latissimus dorsi and the humerus muscle. In addition, the operation rod 9 is provided with two handles 901 and 902 parallel to each other and perpendicular to the operation rod 9 for use in building muscles of specific parts of a human body. The handles 3, 901 and 902 of the prior art exercise machines 1 and 5 are fixed. As a result, one must use a variety of exercise machines to build the muscles of various parts of the body in view of the fact that the effect of the muscle-building exercise depends on the way that the hands grip the handles of the exercise machine.

SUMMARY OF THE INVENTION

The primary objective of the present invention is therefore to provide an exercise machine with a versatile gripping structure enabling an exerciser to hold the gripping structure in various manners so as to do exercises for developing muscles of different parts of the body of the exerciser.

In keeping with the principle of the present invention, the foregoing objective of the present invention is attained by a gripping structure which is fastened at the top end of an operation rod of an exercise machine and is mainly composed of one or more frames and one or more gripping members equal in number to the frame. The frame is formed of two parallel rails which extend from the top end of the operation rod such that the two rails are perpendicular to the operation rod. The gripping member is slidably disposed in the frame such that the gripping member can be moved away from or toward the operation rod, and that the gripping member can be rotated.

DETAILED DESCRIPTION OF THE INVENTION

Figure 1:
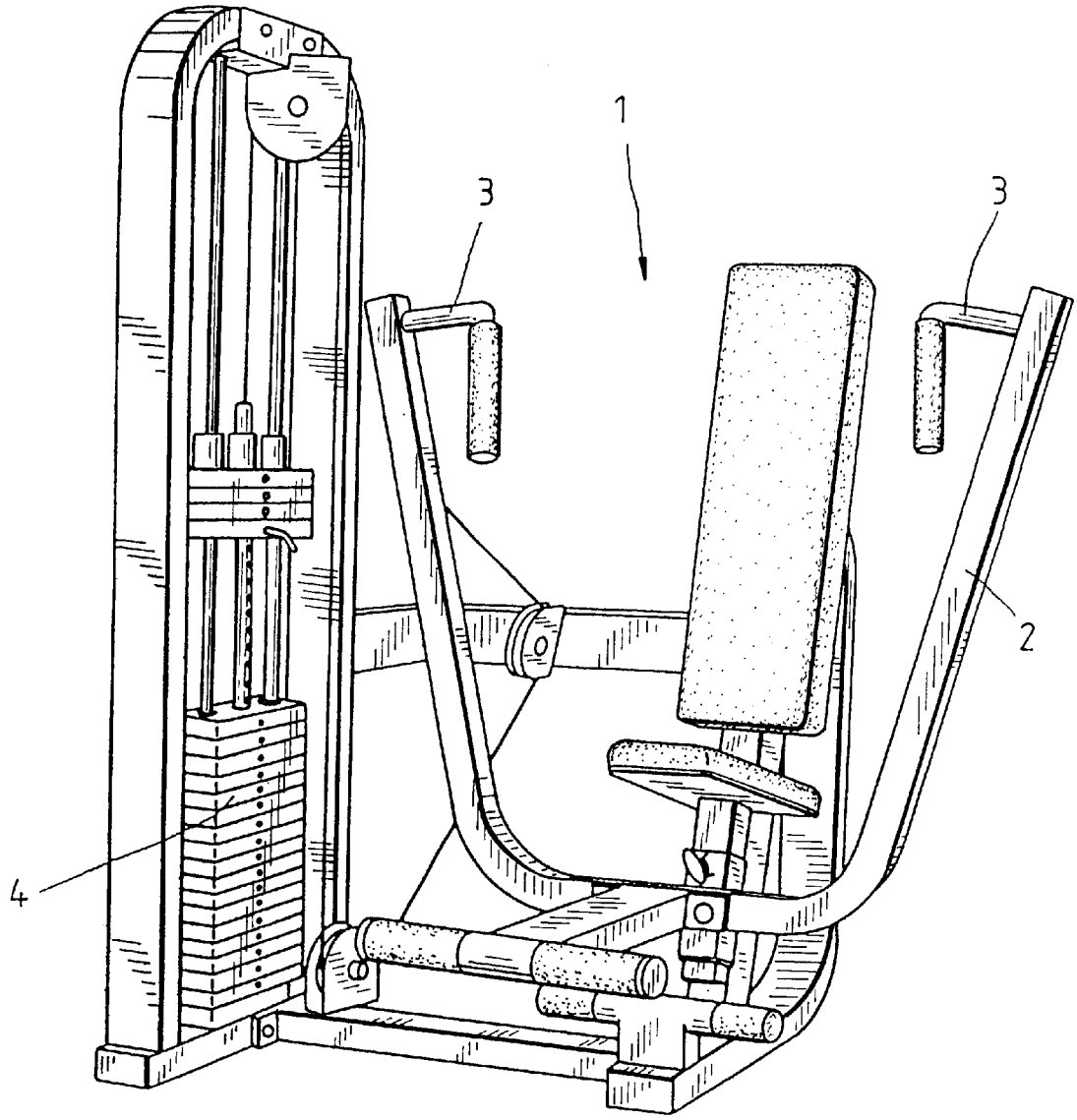
FIG. 1 PRIOR ART
FIG. 1 shows a perspective view of a prior art exercise machine.
Figure 2:
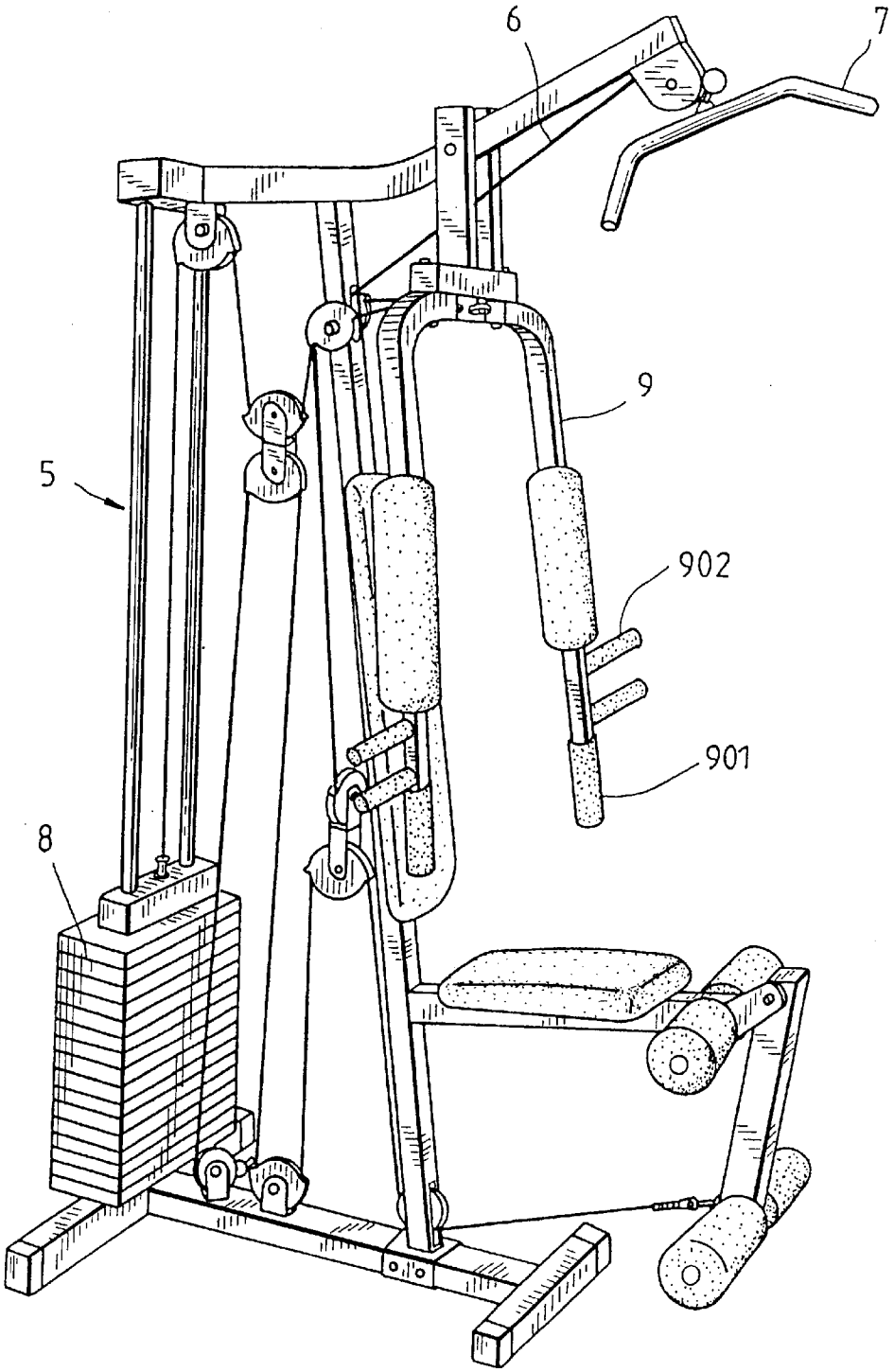
FIG. 2 PRIOR ART
FIG. 2 shows a perspective view of another prior art exercise machine.
Figure 3:
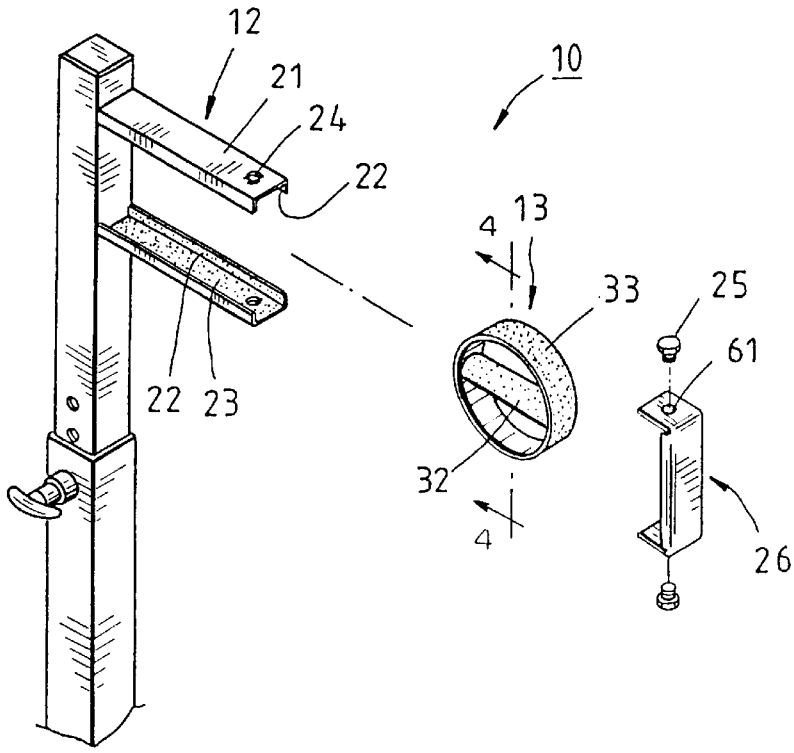
FIG. 3 shows an exploded view of a first preferred embodiment of the present invention.
Figure 4:
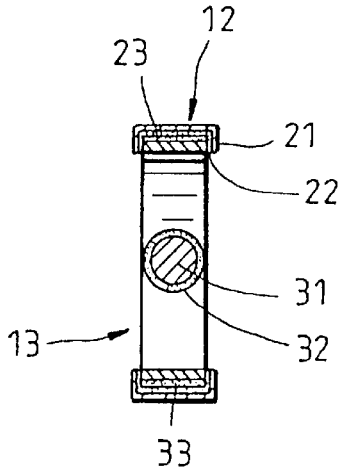
FIG. 4 shows a sectional view of a portion taken along the direction indicated by a line 4—4 as shown in FIG. 3.

As shown in FIGS. 3 and 4, a gripping structure 10 embodied in the present invention is fastened with the force application portion of the operation rods of an exercise machine and is mainly composed of one or more frames 12 and one or more gripping members 13 equal in number to the frame 12.

The frame 12 is formed of two rails 21 parallel to each other and extending from the top end of the operation rod, and a U-shaped end piece 26. The free ends of the two rails 21 are provided with a threaded hole 24, whereas two arms of the U-shaped end piece 26 is provided with a through hole 61. The end piece 26 is fastened with the free ends of the two rails 21 by two fastening screws 25 which are engaged with the threaded holes 24 of the two rails 21 via the through holes 61 of the end pieces 26. The two rails 21 are provided with a slide portion 22, which is covered with a soft plastic pad 23.

The gripping member 13 is of a hollow circular construction having a predetermined diameter and is provided in the hollow interior thereof with a grip portion 31 of a barlike construction. The gripping member 13 has a wall thickness which is equal to a width of the slide portion 22 of the rails 21. The grip portion 31 is covered with a protective jacket 32 of a material having a softness. The grip portion 31 is shaped to facilitate the gripping of the grip portion 31 by hand. The circumferential surface of the gripping member 13 is covered with a pad 33.

Figure 5:
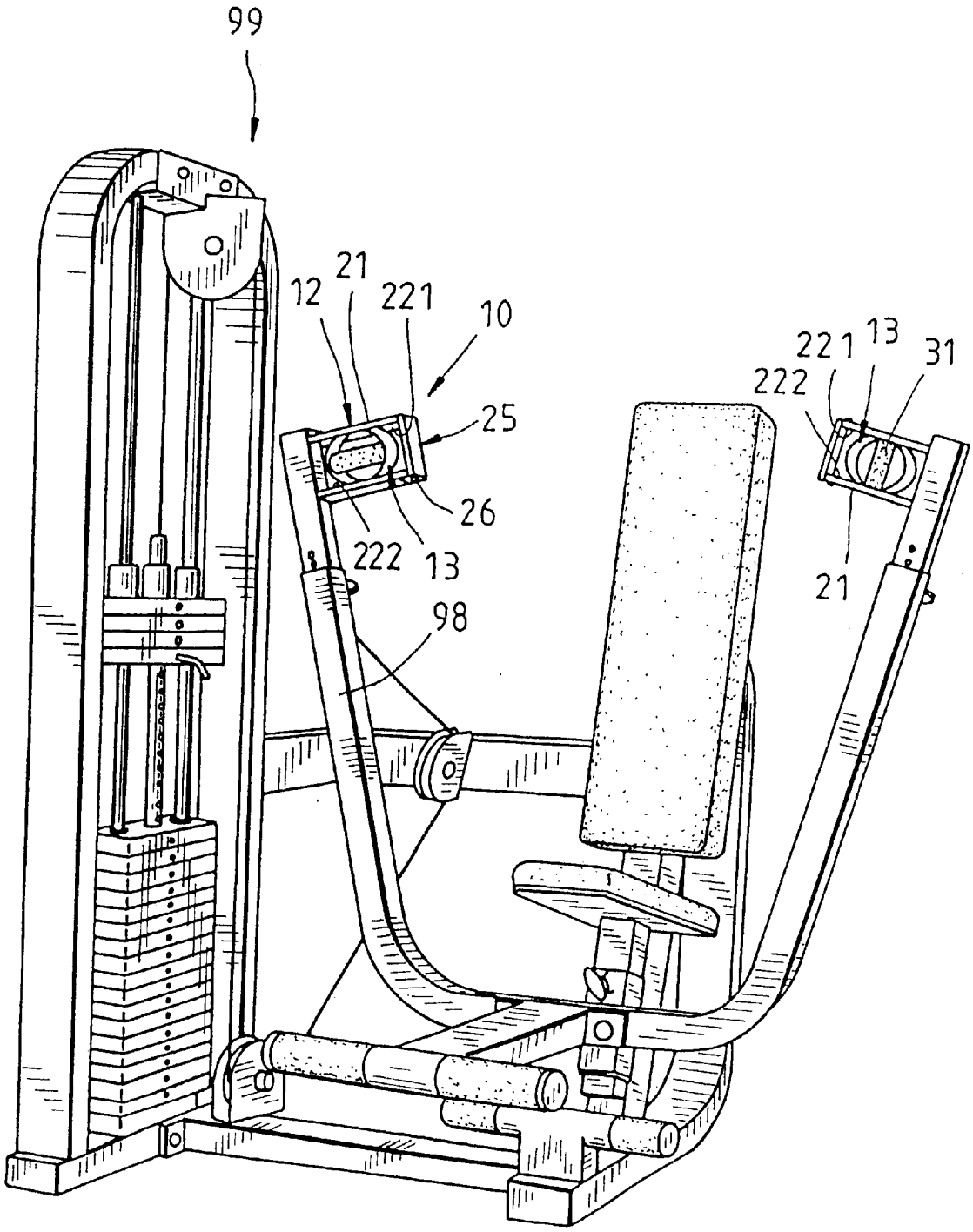
FIG. 5 shows a schematic view of the first preferred embodiment of the present invention at work in conjunction with an exercise machine.

As shown in FIG. 5, the gripping structure 10 of the first preferred embodiment of the present invention is at work with a chest building machine 99 such that the two rails 21 of the frame 12 are extended from the top end of the operation rods 98 of the chest building machine 99, and that the end piece 26 is fastened with the free ends of the two rails 21, and further that the gripping member 13 is slidably disposed between an upper slide portion 221 and a lower slide portion 222. The gripping member 13 can not be easily caused to slide in view of the fact that a frictional resistance is provided by the pad 33 of the gripping member 13 and the pads 23 of the upper slide portion 221 and the lower slide portion 222. The gripping members 13 can be forcefully moved by both hands of an exerciser such that the distance between the two gripping members 13 are increased for training the muscles of the chest of the exerciser, or that the distance between the two gripping members 13 are decreased to allow the distance between the two arms to be equal to the width of the shoulder for training the muscles of the two arms of the exerciser.

The gripping member 13 can be rotated between the two slide portions 221 and 222 of the two rails 21 such that the grip portion 31 is perpendicular to the rails 21, and that the grip portion 31 is parallel to the rails 21, and further that the grip portion 31 is slanted in relation to the rails 21. As a result, the exerciser is provided with various options to hold the gripping structure 10 of the present invention.

Figure 6:
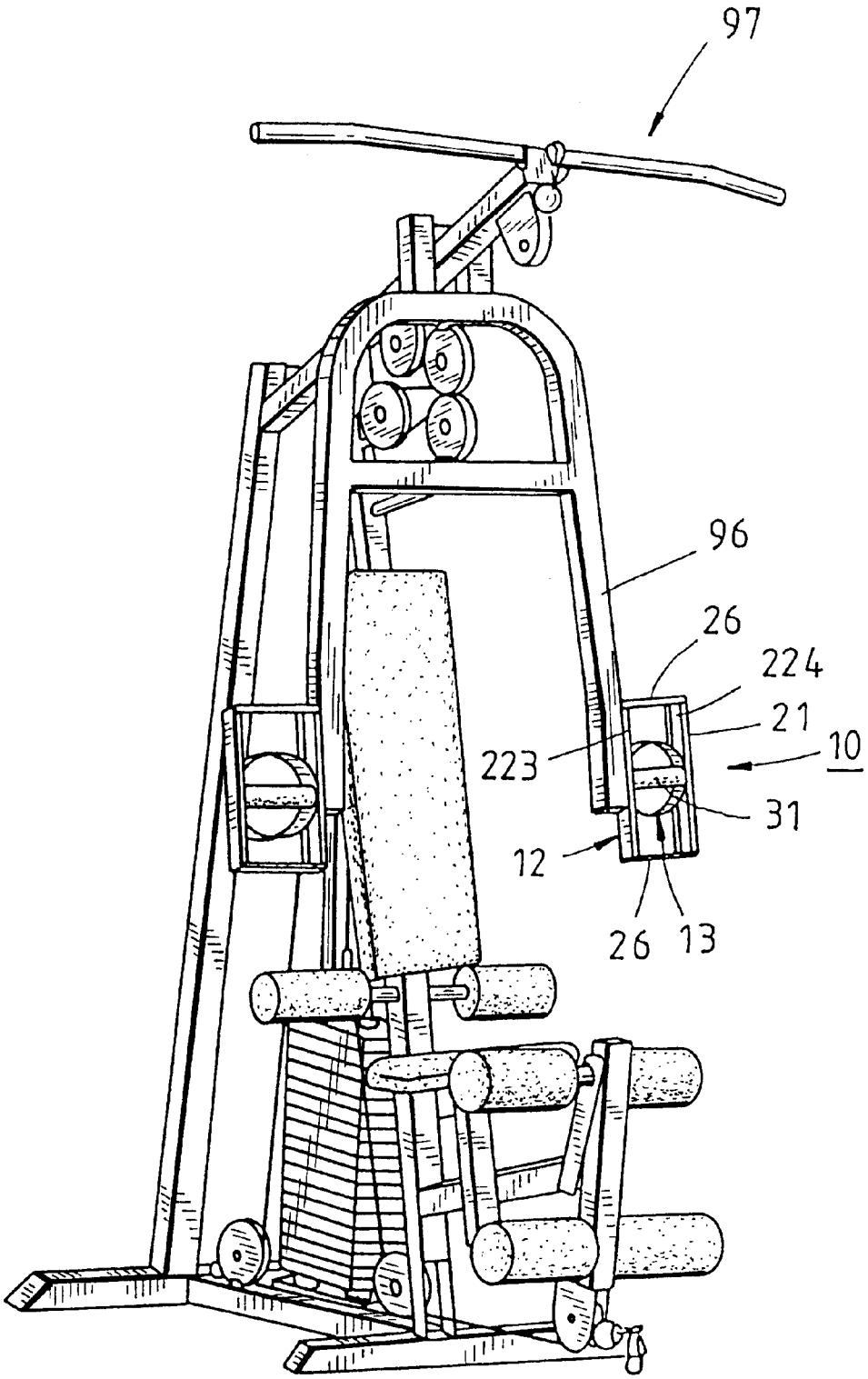
FIG. 6 shows another schematic view of the first preferred embodiment of the present invention at work in conjunction with an exercise machine.

The gripping structure 10 of the present invention is compatible with the exercise machines which are different in function. As shown in FIG. 6, the gripping structure 10 of the present invention is used in conjunction with a shoulder training machine 97 such that the two rails 21 are parallel to the operation rod 96 of the shoulder training machine 97, and that the frame 12 is provided with two end pieces 26 fastened with both ends of the two rails 21. The gripping member 13 is slidably disposed between a left slide portion 223 and a right slide portion 224 such that the gripping member 13 can be slid up and down. As a result, the operation rod 96 can be lifted by both hands holding the gripping members 13 in such a manner that both arms are stretched or bent. The gripping member 13 may be rotatably disposed between the two slide portions 223 and 224.

Figure 7:
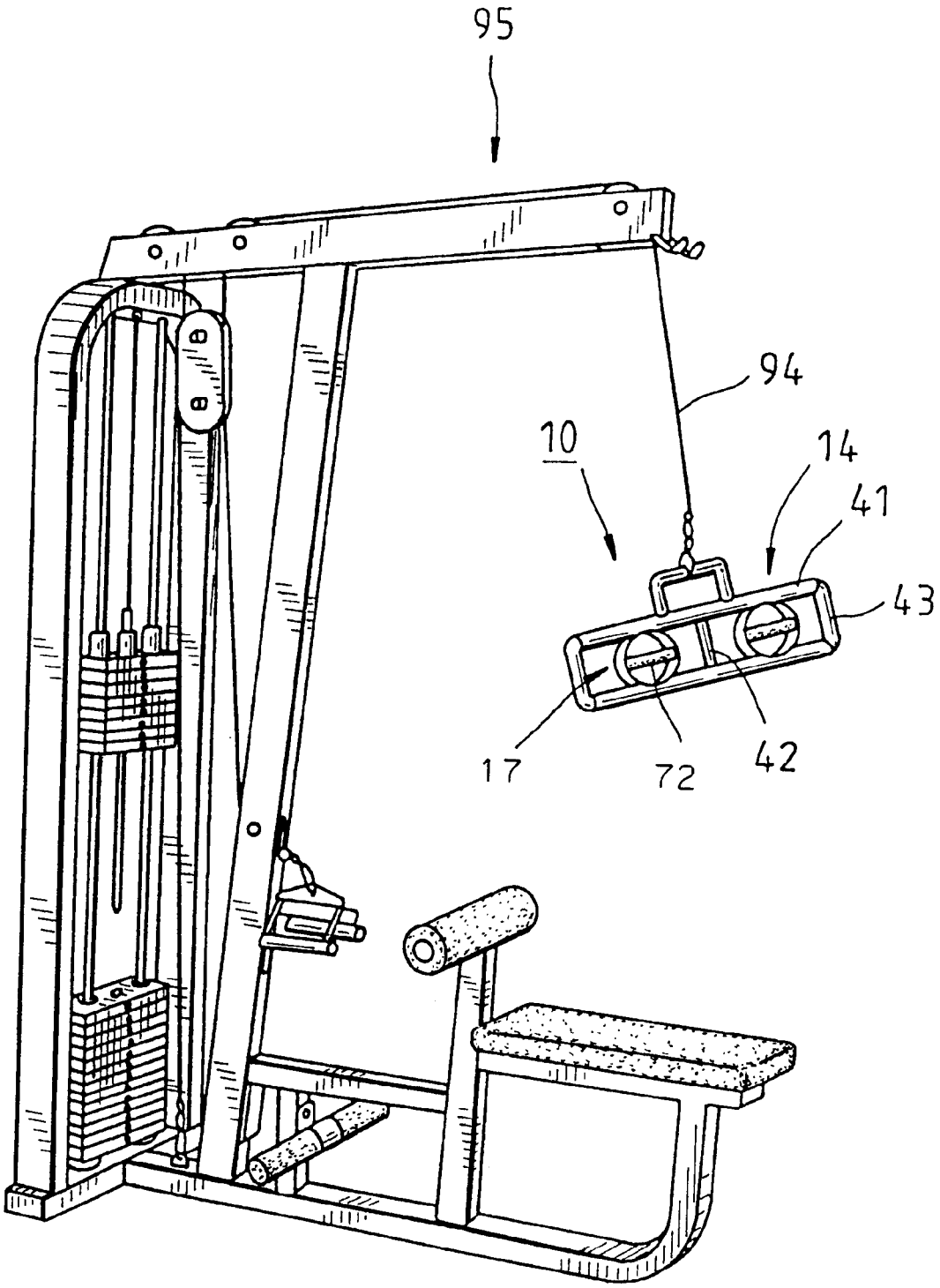
FIG. 7 shows a schematic view of a second preferred embodiment of the present invention at work in conjunction with an exercise machine.
Figure 8:
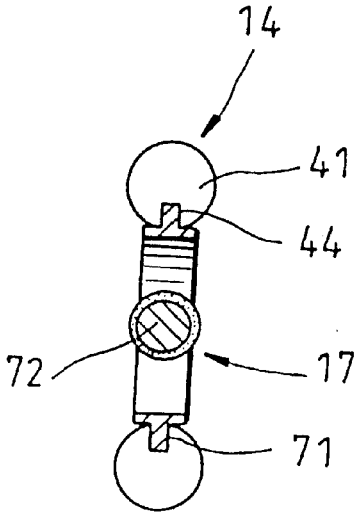
FIG. 8 shows a partial sectional view of the second preferred embodiment of the present invention.

As shown in FIGS. 7 and 8, the second preferred embodiment of the present invention is applied to a so-called "lat machine" 95 such that the gripping structure 10 is fastened with the free end of a pull cord 94 of the machine 95. The gripping structure 10 is formed of a frame 14 and two gripping members 17. The frame 14 is formed of two circular rails 41, a straight bar 42, and two end pieces 43. The rails 41 are provided with a recessed slide portion 44 in which a protruded edge 71 of the gripping member 17 is slidably retained to enable the grip portion 72 to turn.

Figure 9:
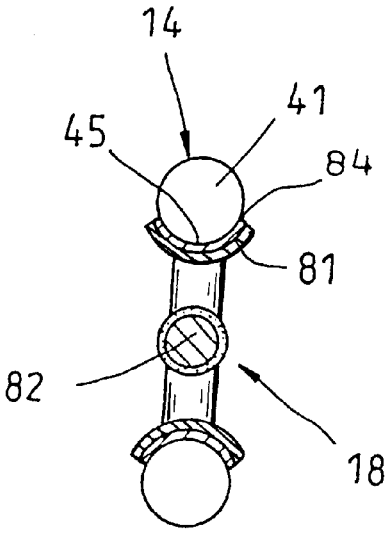
FIG. 9 shows a partial sectional view of a third preferred embodiment of the present invention.

As shown in FIG. 9, the third preferred embodiment of the present invention has two circular rails 41 which are provided with a slide portion 45, and a gripping member 18 which is provided in the outer periphery thereof with an arcuate recess 81 provided with a pad 84 in which the slide portion 45 of the circular rails 41 is received. The gripping member 18 is slid in the slide portion 45 so as to turn the grip portion 82.

Figure 10:
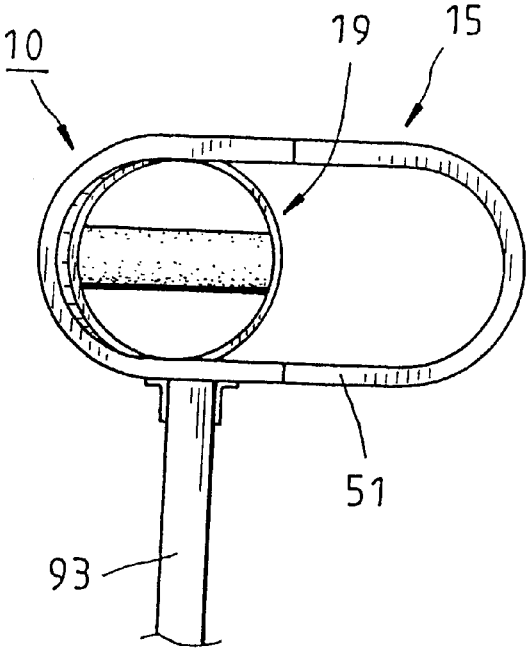
FIG. 10 shows a schematic view of a fourth preferred embodiment of the present invention at work.

As shown in FIG. 10, a gripping structure 10 of the fourth preferred embodiment of the present invention has a frame 15 which is mounted on the end of an operation rod 93 of an exercise machine and is formed of one rail forming an endless unit. The endless frame 15 is provided with a slide portion 51 in which a gripping member 19 is disposed slidably and rotatably.

The advantage of the present invention over the prior art is that the gripping member of present invention is slidably disposed in the rails to enable the grip portion of the gripping member to turn in various directions to facilitate the training of muscles of various parts of an exerciser's body.

What is claimed is:

1. A gripping structure of an exercise machine, the machine having an operation rod with a force application portion, said gripping structure comprising at least one frame and at least one gripping member, said frame being fastened with the force application portion of the operation rod of the exercise machine and having a plurality of rails, said gripping member being provided with a gripping portion to accommodate an exerciser's hand and slidably disposed in said frame such that said gripping member is displaced in a direction away from or toward the operation rod of the exercise machine, wherein:

said rails are provided with an inverted U-shaped slide portion;

said gripping member is of a circular construction and is received in said slide portion; and said slide portion is provided with a pad.

2. The gripping structure as defined in claim 1, wherein said frame is formed of two rails extending from the operation rod of the exercise machine, an end piece fastened with free ends of said two rails, an upper slide portion, and a lower slide portion; and wherein said gripping member slides horizontally along said upper slide portion and said lower slide portion.

3. The gripping structure as defined in claim 1, wherein said frame is formed of two rails parallel to the operation rod of the exercise machine, two end pieces fastened with both ends of said two rails, a left slide portion, and a right slide portion; and wherein said gripping member slides vertically along said two rails.

4. The gripping structure as defined in claim 1, wherein said frame is fastened with an end of the operation rod of the exercise machine and is formed of an endless rail, a first slide portion, and a second slide portion parallel to said first slide portion; and wherein said gripping member slides along said first slide portion and said second slide portion.

5. The gripping structure as defined in claim 1, wherein said gripping portion of said gripping member is a bar which is covered with a protective jacket.

6. The gripping structure as defined in claim 1, wherein said gripping member rotates in relation to said rails, thereby resulting in a change in orientation of said gripping portion of said gripping member.

7. A gripping structure of an exercise machine, the machine having an operation rod with a force application portion, said gripping structure comprising at least one frame and at least one gripping member, said frame being fastened with the force application portion of the operation rod of the exercise machine and having a plurality of rails, said gripping member being provided with a gripping portion to accommodate an exerciser's hand and slidably disposed in said frame such that said gripping member is displaced in a direction away from or toward the operation rod of the exercise machine, wherein:

said gripping member is provided in an outer periphery thereof with a recessed portion for covering a portion of the outer periphery of said rails; and said recessed portion of said gripping member is provided with a pad.

8. The gripping structure as defined in claim 7, wherein said frame is formed of two rails extending from the operation rod of the exercise machine, an end piece fastened with free ends of said two rails, an upper slide portion, and a lower slide portion; and wherein said gripping member slides horizontally along said upper slide portion and said lower slide portion.

9. The gripping structure as defined in claim 7, wherein said frame is formed of two rails parallel to the operation rod of the exercise machine, two end pieces fastened with both ends of said two rails, a left slide portion, and a right slide portion; and wherein said gripping member slides vertically along said two rails.

10. The gripping structure as defined in claim 7, wherein said frame is fastened with an end of the operation rod of the exercise machine and is formed of an endless rail, a first slide portion, and a second slide portion parallel to said first slide portion; and wherein said gripping member slides along said first slide portion and said second slide portion.

11. The gripping structure as defined in claim 7, wherein said gripping portion of said gripping member is a bar which is covered with a protective jacket.

12. The gripping structure as defined in claim 7, wherein said gripping member rotates in relation to said rails, thereby resulting in a change in orientation of said gripping portion of said gripping member.

* * * * *